US010731819B2

(12) United States Patent
Yagi

(10) Patent No.: US 10,731,819 B2
(45) Date of Patent: Aug. 4, 2020

(54) VEHICLE HEADLAMP

(71) Applicant: KOITO MANUFACTURING CO., LTD., Tokyo (JP)

(72) Inventor: Takayuki Yagi, Shizuoka (JP)

(73) Assignee: KOITO MANUFACTURING CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/086,944

(22) PCT Filed: Mar. 23, 2017

(86) PCT No.: PCT/JP2017/011795
§ 371 (c)(1),
(2) Date: Sep. 20, 2018

(87) PCT Pub. No.: WO2017/164327
PCT Pub. Date: Sep. 28, 2017

(65) Prior Publication Data

US 2019/0093848 A1 Mar. 28, 2019

(30) Foreign Application Priority Data

Mar. 24, 2016 (JP) ..... 2016-059505

(51) Int. Cl.
*F21S 41/675* (2018.01)
*F21S 43/00* (2018.01)
(Continued)

(52) U.S. Cl.
CPC ..... *F21S 41/675* (2018.01); *F21S 41/00* (2018.01); *F21S 41/176* (2018.01); *F21S 41/25* (2018.01); *F21S 41/285* (2018.01); *F21S 43/00* (2018.01)

(58) Field of Classification Search
CPC ..... F21S 41/675; F21S 41/00; F21S 41/143; F21S 41/147; F21S 41/148
See application file for complete search history.

(56) References Cited

U.S. PATENT DOCUMENTS

2011/0044046 A1* 2/2011 Abu-Ageel ..... F21K 9/00 362/259
2011/0249460 A1* 10/2011 Kushimoto ..... B60Q 1/085 362/510
(Continued)

FOREIGN PATENT DOCUMENTS

CN 103574473 A 2/2014
CN 104040249 A 9/2014
(Continued)

OTHER PUBLICATIONS

Written Opinion (PCT/ISA/237) issued by the International Searching Authority in corresponding International Application No. PCT/JP2017/011795, dated Jun. 20, 2017.
(Continued)

*Primary Examiner* — Evan P Dzierzynski
(74) *Attorney, Agent, or Firm* — Sughrue Mion, PLLC

(57) ABSTRACT

Provided is a vehicle headlamp which is capable of forming a light distribution pattern with a high degree of flexibility in shape. A vehicle headlamp includes an excitation light source, a phosphor, a scanning mechanism which includes a reflecting mirror configured to be swingable and which is configured to receive light emitted from the excitation light source on a reflecting surface of the reflecting mirror to scan light reflected on the reflecting surface toward the phosphor, a projection lens which is configured to transmit therethrough light emitted from the phosphor to form a light distribution pattern, and a condensing lens which is configured to condense the light emitted from the excitation light source onto the reflecting surface.

10 Claims, 10 Drawing Sheets

(51) Int. Cl.

| | |
|---|---|
| ***F21S 41/00*** | (2018.01) |
| ***F21S 41/25*** | (2018.01) |
| ***F21S 41/176*** | (2018.01) |
| ***F21S 41/20*** | (2018.01) |

(56) References Cited

U.S. PATENT DOCUMENTS

2012/0098819 A1* 4/2012 Furuya ..... G02B 5/32 345/212
2012/0106188 A1* 5/2012 Takahashi ..... F21S 41/14 362/516
2012/0163009 A1 6/2012 Nakazato et al.
2012/0224384 A1* 9/2012 Takahira ..... F21V 9/30 362/509
2012/0236046 A1* 9/2012 Sugiyama ..... G02B 27/01 345/690
2012/0250306 A1* 10/2012 Sugiyama ..... B60K 35/00 362/231
2012/0262680 A1 10/2012 Hudman
2013/0258689 A1* 10/2013 Takahira ..... F21V 14/00 362/465
2014/0029282 A1 1/2014 Ravier et al.
2015/0016134 A1* 1/2015 Erdl ..... G02B 26/101 362/510
2015/0160454 A1* 6/2015 Bhakta ..... G02B 26/0833 362/513
2015/0176778 A1 6/2015 Schwaiger et al.
2015/0176805 A1 6/2015 Schwaiger et al.
2015/0362154 A1* 12/2015 Liao ..... F21V 9/40 362/84
2015/0369437 A1 12/2015 Reinprecht et al.
2015/0369440 A1 12/2015 Reinprecht et al.
2015/0375672 A1* 12/2015 Takahashi ..... G02B 6/0068 701/49
2016/0153633 A1* 6/2016 Shibata ..... F21S 41/14 362/510
2016/0215947 A1* 7/2016 Matsuno ..... F21S 41/24
2016/0255319 A1* 9/2016 Miyamoto ..... G02B 27/0101 348/602
2016/0334637 A1* 11/2016 Saisho ..... H04N 9/3161
2017/0016588 A1 1/2017 Saito
2017/0138556 A1* 5/2017 Hager ..... F21S 43/13
2017/0175968 A1 6/2017 Shimizu et al.
2017/0282783 A1 10/2017 Ravier et al.
2017/0321857 A1 11/2017 Reisinger et al.
2017/0337821 A1* 11/2017 Masuda ..... B60Q 1/00
2018/0147978 A1* 5/2018 Reisinger ..... G02B 27/0983

FOREIGN PATENT DOCUMENTS

| | | | |
|---|---|---|---|
| CN | 105371205 | A | 3/2016 |
| EP | 2 963 476 | A1 | 1/2016 |
| EP | 3 096 074 | A1 | 11/2016 |
| JP | 04314321 | A | 11/1992 |
| JP | 2011-100684 | A | 5/2011 |
| JP | 2011-142000 | A | 7/2011 |
| JP | 2012-164585 | A | 8/2012 |
| JP | 2014-065499 | A | 4/2014 |
| WO | 2014/121314 | A1 | 8/2014 |
| WO | 2015/146309 | A1 | 10/2015 |
| WO | 2015/190437 | A1 | 12/2015 |
| WO | 2016/042052 | A1 | 3/2016 |
| WO | 2016/061599 | A1 | 4/2016 |

OTHER PUBLICATIONS

International Search Report (PCT/ISA/210), issued by International Searching Authority in corresponding International Application No. PCT/JP2017/011795, dated Jun. 20, 2017.
Search Report dated Oct. 28, 2019 by the European Patent Office in counterpart European Patent Application No. 17770367.5.
Communication dated Mar. 30, 2020 from the State Intellectual Property Office of the P.R.China in application No. 201780017481.9.
Communication dated Apr. 7, 2020 from the Japanese Patent Office in application No. 2016-059505.

* cited by examiner

31

VEHICLE HEADLAMP

TECHNICAL FIELD

The present disclosure relates to a vehicle headlamp capable of forming a light distribution pattern with a high degree of flexibility in shape.

BACKGROUND ART

Patent Document 1 discloses a vehicle headlamp configured to form a light distribution pattern by reflecting and scanning light, which is emitted from a laser device (a light source), to a phosphor panel with a Micro Electro Mechanical Systems (MEMS) mirror which is two-dimensionally tiltable.

PRIOR ART DOCUMENT

Patent Document

Patent Document 1: JP-A-2014-65499

SUMMARY OF THE INVENTION

Problem to be Solved

According to the vehicle headlamp disclosed in Patent Document 1, since the light emitted from the laser light source diffuses toward the MEMS mirror, the light reflected by the MEMS mirror may be reflected to be focused at a position of the phosphor panel arranged in the vicinity of a rear focal point of a projection lens. When the light incident on the phosphor panel so as to be focused is scanned by one MEMS mirror which is two-dimensionally tiltable, a shape of a light distribution pattern to be formed by way of the projection lens is limited to a rod shape. Therefore, a light distribution pattern having a flexibility in shape cannot be formed.

In view of the above circumstances, the present disclosure provides a vehicle headlamp capable of forming a light distribution pattern with a high degree of flexibility in shape.

Means for Solving the Problem

One aspect of the present disclosure provides a vehicle headlamp including an excitation light source, a phosphor, a scanning mechanism which includes a reflecting mirror configured to be swingable and which is configured to receive light emitted from the excitation light source on a reflecting surface of the reflecting mirror to scan light reflected on the reflecting surface toward the phosphor, a projection lens which is configured to transmit therethrough light emitted from the phosphor to form a light distribution pattern, and a condensing lens which is configured to condense the light emitted from the excitation light source onto the reflecting surface.

According to the above configuration, the light incident on the phosphor from the scanning mechanism is scanned in a swinging direction of the reflecting mirror while being diffused on the phosphor in a direction perpendicular to the swinging direction of the reflecting mirror.

In the vehicle headlamp according to one aspect of the present disclosure, the condensing lens may include a first lens configured to change a condensing magnification in a first direction and a second lens disposed in series with the first lens and configured to change a condensing magnification in a second direction perpendicular to the first direction.

According to the above configuration, a laser light, which is naturally to diffuse in an elliptical shape, sequentially passes through the first lens and the second lens, so that the condensing magnification in the first direction and the condensing magnification in the second direction are changed. Accordingly, a flexible light image such as a circular shape is irradiated on the phosphor.

In the vehicle headlamp according to one aspect of the present disclosure, the phosphor may be disposed with being inclined with respect to a direction perpendicular to an optical axis of the projection lens.

According to the above configuration, the phosphor is disposed to directly face the reflecting surface of the reflecting mirror of the scanning mechanism, so that a shape of a light image of the reflected light incident on the phosphor is formed narrow in an inclination direction of the reflecting mirror with respect to the projection lens.

The vehicle headlamp according to one aspect of the present disclosure may further include a deflector lens which is disposed between the reflecting surface of the reflecting mirror and the phosphor. The deflector lens has a first region configured to simply transmit the reflected light therethrough and a second region configured to transmit the reflected light therethrough to be condensed or diffused in accordance with a swinging direction of the reflecting mirror.

According to the above configuration, the reflecting mirror of the scanning mechanism swings at high speed, so that it alternately faces the first region and the second region of the deflector lens. The light reflected by the swinging reflecting mirror is alternately incident on the first region and the second region of the deflector lens and then passes through the phosphor. The light incident on the first region of the deflector lens passes without refraction, thereby forming a diffusion region of the light distribution pattern. The light passing through the second region of the deflector lens is condensed or diffused in a predetermined direction, so that it is irradiated to an inner side of the diffusion region. The light passing through the second region is condensed to the inner side of the diffusion region of the light distribution pattern, thereby forming a region (hot spot) brighter than the diffusion region in the light distribution pattern.

The vehicle headlamp according to one aspect of the present disclosure may further include a re-reflecting mirror which is configured to re-reflect the light reflected by the reflecting mirror swinging at a part of a scanning region scanned by the scanning mechanism.

According to the above configuration, the light reflected by the reflecting mirror of the scanning mechanism is re-reflected toward the projection lens by the re-reflecting mirror, at the part of the scanning region scanned by the scanning mechanism. The light having passed through the projection lens without being incident on the re-reflecting mirror forms the diffusion region of the light distribution pattern, and the light re-reflected by the re-reflecting mirror and having passed through the projection lens is irradiated to the inner side of the diffusion region, thereby forming a region (hot spot) brighter than the diffusion region in the light distribution pattern.

In the vehicle headlamp according to one aspect of the present disclosure, the condensing lens may include an anamorphic lens.

According to the above configuration, the laser light, which is naturally to diffuse in an elliptical shape, passes through the anamorphic lens, so that the light image is compressed and enlarged. Thereby, a flexible light image such as a circular shape is irradiated onto the phosphor.

In the vehicle headlamp according to one aspect of the present disclosure, a light image of the reflected light incident on the phosphor from the reflecting surface may be formed larger than a light image of an incident light onto the reflecting surface.

According to the above configuration, the light incident to be condensed onto the reflecting surface of the reflecting mirror of the scanning mechanism is incident on the phosphor with being diffusively reflected.

In the vehicle headlamp according to one aspect of the present disclosure, a light image of the reflected light incident on the phosphor from the reflecting surface may be formed smaller than a light image of an incident light onto the reflecting surface.

According to the above configuration, the light reflected by the reflecting mirror of the scanning mechanism is incident on the phosphor with being condensed.

Effects

According to the vehicle headlamp of one aspect of the present disclosure, since the light diffusing in the direction perpendicular to the swinging direction of the reflecting mirror is scanned, the light distribution pattern having a high degree of flexibility in shape is formed without being limited to a rod shape.

According to the vehicle headlamp of one aspect of the present disclosure, since it is possible to flexibly change a shape of the light image to be irradiated onto the phosphor, the light distribution pattern having a higher degree of flexibility is formed by scanning the light image.

According to the vehicle headlamp of one aspect of the present disclosure, since it is possible to narrowly form a shape of the light image to be irradiated onto the phosphor by the inclination direction of the reflecting mirror with respect to the projection lens, the light distribution pattern having a higher degree of flexibility is formed by scanning the light image.

According to the vehicle headlamp of one aspect of the present disclosure, it is possible to form the diffusion region having a predetermined shape and the condensing region having a predetermined shape narrower and brighter than the diffusion region at the predetermined position of the inner side of the diffusion region, so that the light distribution pattern having a high degree of flexibility is formed or a light distribution pattern having a uniform light beam distribution is formed.

According to the vehicle headlamp of one aspect of the present disclosure, the very small spot light image is irradiated onto the phosphor, so that a resolution of the reflected light to be used for the scanning is improved and a resolution of the light distribution pattern is thus improved.

DETAILED DESCRIPTION OF EMBODIMENTS

Hereinafter, embodiments of the present disclosure will be described with reference to FIGS. 1 to 10B. In the respective drawings, respective directions of a vehicle headlamp are described as (upper: lower: left: right: front: rear=Up: Lo: Le: Ri: Fr: Re).

First Embodiment

Figure 1:
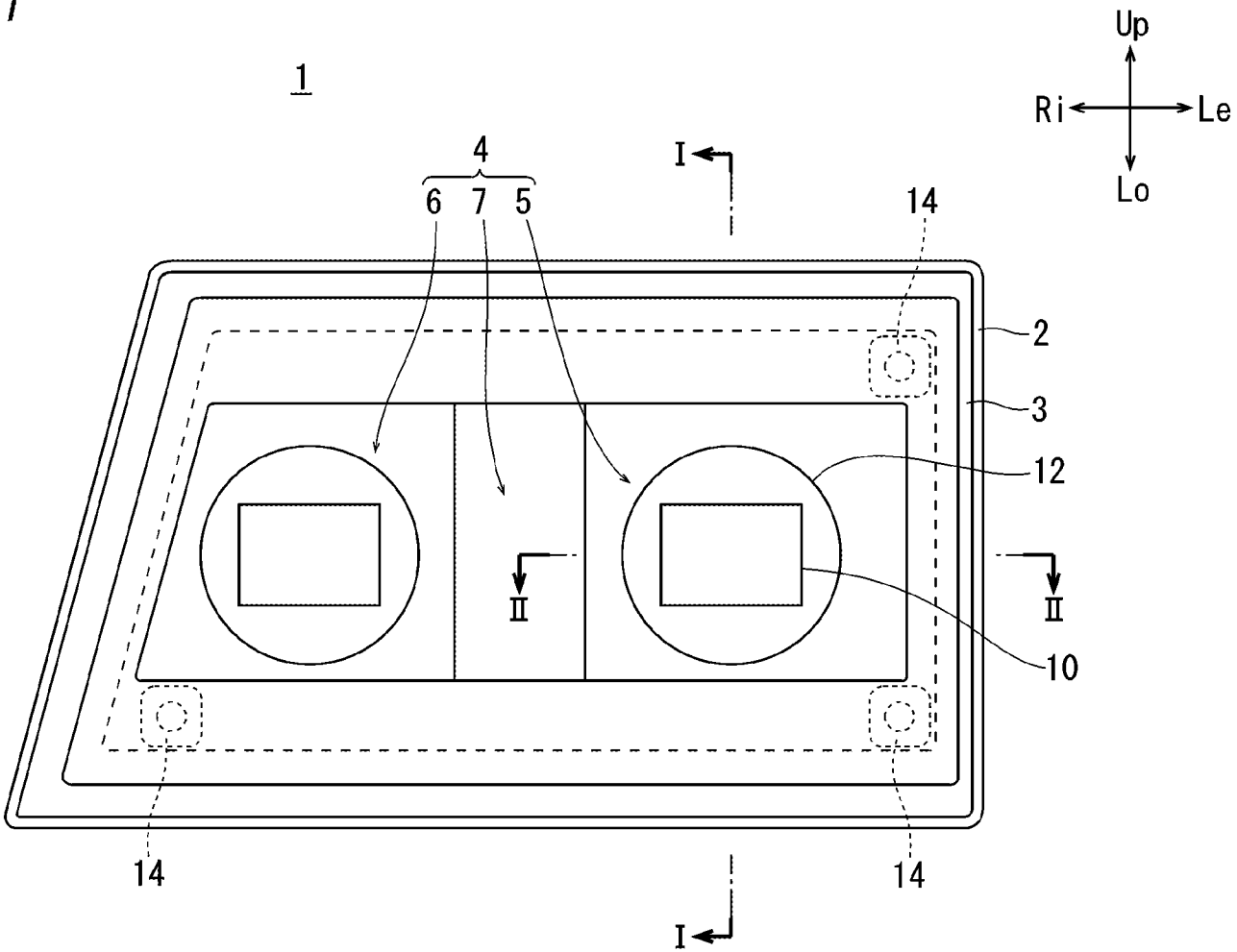
FIG. 1 is a front view of a vehicle headlamp in accordance with each embodiment.
Figure 2:
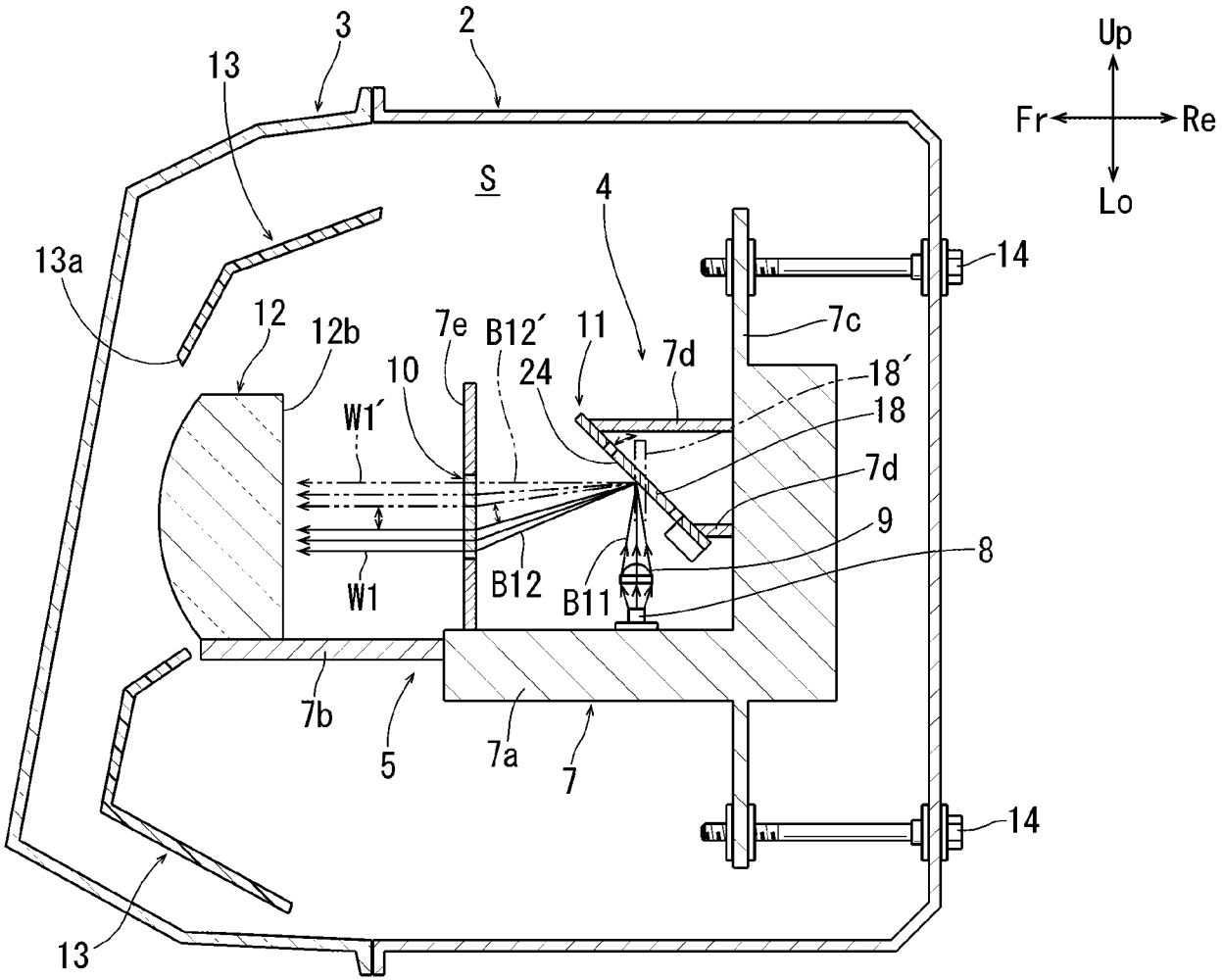
FIG. 2 is a longitudinal sectional view of a vehicle headlamp having a light transmission-type phosphor in accordance with a first embodiment, taken along a line I-I of FIG. 1.

A vehicle headlamp 1 of a first embodiment shown in FIGS. 1 and 2 is an example of a right headlamp having a light transmission-type phosphor, and includes a lamp body 2, a front cover 3, and a headlamp unit 4. The lamp body 2 has an opening at a front side of a vehicle. The front cover 3 is formed of light-transmitting resin, glass or the like and is mounted to the opening of the lamp body 2 to form a lamp chamber S (refer to FIG. 2).

The headlamp unit 4 shown in FIG. 1 is configured by integrating a headlamp unit 5 for high beam and a headlamp unit 6 for low beam with a metallic support member 7, and is disposed in the lamp chamber S.

Each of the headlamp unit 5 for high beam and the headlamp unit 6 for low beam includes an excitation light source 8, a condensing lens 9, a phosphor 10, a scanning mechanism 11 and a projection lens 12, which are all mounted to the support member 7. The support member 7 has a plate-shaped bottom plate part 7*a* extending in a horizontal direction, a lens support part 7*b* extending forward from a leading end of the bottom plate part 7*a*, and a plate-shaped base plate part 7*c* perpendicularly extending from a base end of the bottom plate part 7*a*.

As shown in FIG. 2, the excitation light source 8 and the phosphor 10 are fixed to the metallic bottom plate part 7*a*. The scanning mechanism 11 is fixed to a front surface of the base plate part 7*c* by a mounting part 7*d*. The condensing lens 9 is fixed to the bottom plate part 7*a* or the base plate part 7*c*. The projection lens 12 is fixed to an upper surface of a leading end of the lens support part 7*b*. Three aiming screws 14 rotatably kept to the lamp body 2 are screwed to the base plate part 7*c*, so that the support member 7 of the headlamp unit 4 is tiltably supported to the lamp body 2.

The excitation light source 8 is configured by a blue or purple LED light source or a laser light source, and heat during lighting is dissipated via the bottom plate part 7*a* which is thicker vertically than the base plate part 7*c*.

The condensing lens 9 and the projection lens 12 are a transparent or semi-transparent plano-convex lens of which a light emission surface has a convex shape, respectively. The condensing lens 9 is fixed to the support member 7 by a support part (not shown) to be disposed between the excitation light source 8 and a reflecting surface 24 of the scanning mechanism 11. The condensing lens 9 is configured to condense light B11 from the excitation light source 8 to be incident on the reflecting surface 24.

The phosphor 10 is configured to generate white light based on the light from the excitation light source 8. When the excitation light source 8 is blue, the phosphor 10 is formed as a yellow phosphor. When the excitation light source 8 is purple, the phosphor 10 is formed as a yellow and blue phosphor or as a phosphor having at least three colors of red, green and blue (RGB).

The phosphor 10 is fixed to the bottom plate part 7*a* via a frame body 7*e* to be disposed between the reflecting surface 24 of the scanning mechanism 11 and a light incidence surface 12*b* of the projection lens 12. The phosphor 10 is configured to form blue or purple reflected light B12 from the reflecting surface 24 into white light W1 and to transmit the same toward the projection lens.

The projection lens 12 is disposed in the vicinity of a front end opening 13*a* of an extension reflector 13 provided in the lamp chamber S. The projection lens 12 is configured to transmit therethrough the light having passed through the phosphor 10 and incident on the projection lens 12 toward the front cover 3.

Figure 3A:
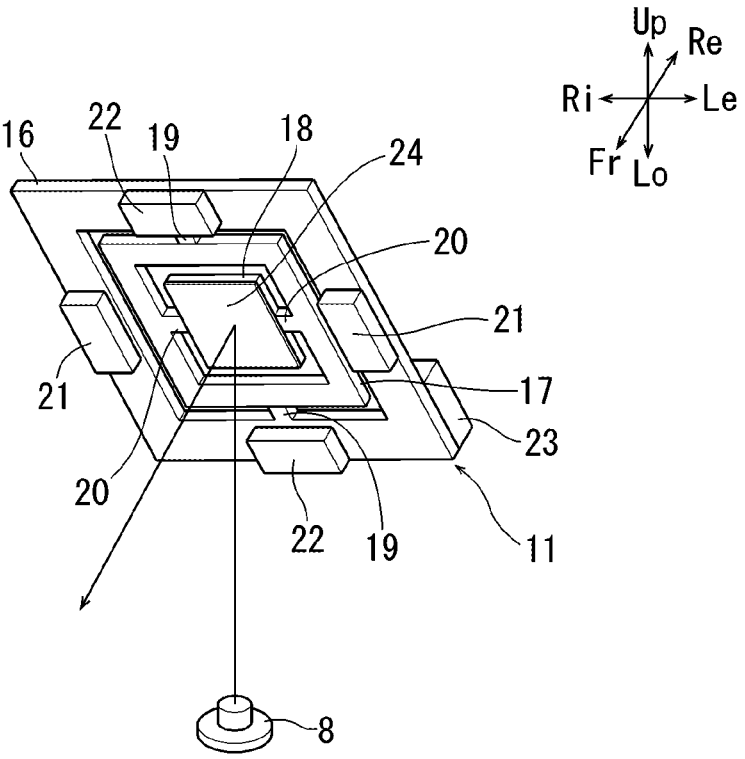
FIG. 3A is a perspective view of a scanning mechanism, as seen from the front.

The scanning mechanism 11 shown in FIG. 3A is a scanning device having a reflecting mirror which is tiltable in a biaxial direction. In the first embodiment, a MEMS mirror is adopted, for example. However, as the scanning mechanism 11, a variety of scanning mechanisms such as a Galvano-mirror may be adopted. The scanning mechanism 11 includes a base 16, a first rotating body 17, a second rotating body 18, a pair of first torsion bars 19, a pair of second torsion bars 20, a pair of permanent magnets 21, a pair of permanent magnets 22 and a terminal part 23. The second rotating body 18 is a plate-shaped reflecting mirror. A front surface of the second rotating body 18 is formed thereon with the reflecting surface 24 by silver vapor deposition, plating or the like.

The plate-shaped first rotating body 17 is supported to the base 16 to be tiltable right and left by the pair of first torsion bars 19. The second rotating body 18 is supported to the first rotating body 17 to be rotatable up and down by the pair of second torsion bars 20. The pair of permanent magnets 21 and the pair of permanent magnets 22 are respectively provided on the base 16 in extension directions of the pair of first torsion bars 19 and the second torsion bars 20. The pair of the first rotating body 17 and the second rotating body 18 are respectively provided with first and second coils (not shown) which are to be energized via the terminal part 23. The energizations of the first and second coils (not shown) are independently controlled by a control mechanism (not shown), respectively.

The first rotating body 17 shown in FIG. 3A is configured to be reciprocally tilted about an axis of the first torsion bar 19 based on ON or OFF of the energization to the first coil (not shown). The second rotating body 18 is configured to be reciprocally tilted about an axis of the second torsion bar 20 based on ON or OFF of the energization to the second coil (not shown) (refer to the reference numerals 18 and 18' of FIG. 2). In the meantime, the member and light displaced by the tilting or swinging are respectively denoted with a reference numeral having an apostrophe (').

The reflecting surface 24 is configured to be tilted up and down and right and left based on the energization to the first or second coil (not shown) to scan the reflected light toward the phosphor 10 up and down and right and left. The reflected light B12 reflected by the reflecting surface 24 is scanned right and left (not shown) based on the swinging of the first rotating body 17 and is scanned up and down based on the swinging of the second rotating body 18 (refer to the reference numerals B12 and B12' of FIG. 2), as shown in FIG. 2.

The light W1 having passed through the phosphor 10 passes through the projection lens 12 and the front cover 3 while being scanned up and down and right and left (refer to the reference numerals W1 and W1' of FIG. 2), and forms a white light distribution pattern having a predetermined shape based on the scanning, in front of the vehicle.

Here, an example of a light distribution pattern which is to be formed in front of the vehicle by the scanning to be performed by the headlamp unit 5 for high beam is described with reference to FIG. 3B. The reference numerals S11 to S14 indicate trajectories of scanning lines formed by the scanning mechanism 11.

Figure 3B:
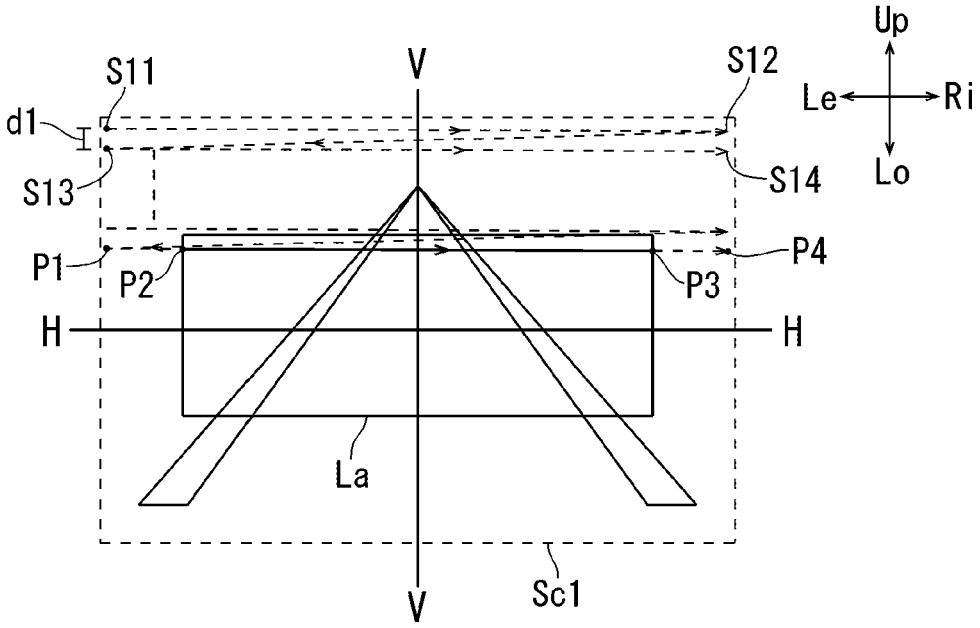
FIG. 3B illustrates a light distribution pattern for high beam to be formed by the vehicle headlamp.

In a rectangular scanning region (the reference numeral Sc1) ahead of the vehicle, as shown in FIG. 3B, the scanning mechanism 11 of FIG. 3A repetitively performs, at high speed, processing of performing the scanning from a left end S11 to a right end S12 of the scanning region Sc1 based on the tilting of the reflecting surface 24, then tilting the reflecting surface 24 leftward and downward toward a next left end S13 displaced downward from the left end S11 by a minor distance d1 and again performing the scanning toward a right end S14. At a position at which the light distribution pattern is formed, the excitation light source 8 turns off the light for a section from P1 to P2, in which the light distribution pattern is not to be formed, turns on the light for a section from P2 to P3, in which a light distribution pattern La for high beam is to be formed, and again turns off the light for a section from P3 to P4 after the formation is over, based on a lighting control device (not shown). The scanning mechanism 11 repetitively performs, at high speed, the scanning in the scanning region Sc1 downward of the scanning region Sc1, and overlaps line images up and down, thereby forming the light distribution pattern La for high beam in front of the vehicle.

The headlamp unit 6 for low beam performs scanning, which is similar to the scanning formed by the scanning mechanism 11 of the headlamp unit 5 for high beam, thereby forming a light distribution pattern for low beam (not shown).

Figure 4A:
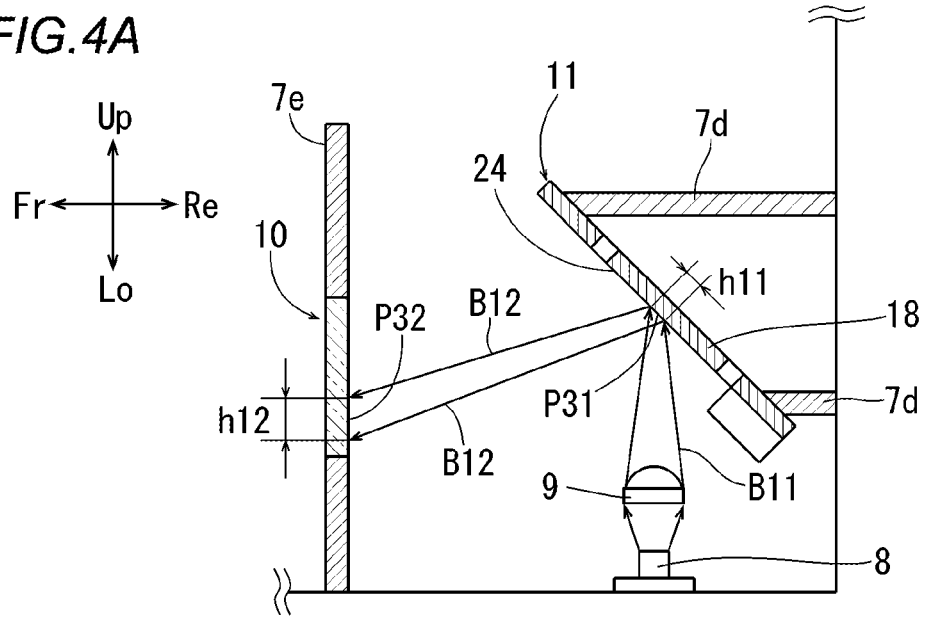
FIG. 4A is a partially enlarged sectional view of a headlamp unit in which a light image to be irradiated onto the phosphor is formed larger than a light image to be irradiated onto a reflecting mirror.

In the meantime, as shown in FIG. 4A, the smaller a size (height h11) of a light image P31 formed by the light B11 irradiated onto the reflecting surface 24 by the condensing lens 9 is, a size (height h12) of a light image P32 formed by the reflected light B12 irradiated onto the phosphor 10 by the reflected light B12 of the scanning mechanism 11 increases. That is, the light incident on the reflecting surface 24 of the scanning mechanism 11 with being condensed is reflected and diffused on the reflecting surface 24 and is then incident on the phosphor 10. The light image P32 of the reflected light B12 incident on the phosphor 10 from the reflecting surface 24 is formed larger than the light image P31 of the incident light B11 onto the reflecting surface 24. When the sizes of the light images P31, P32 are set to be h12>h11, a height of the light image for scanning is enlarged, so that the vehicle headlamp 1 forms a light distribution pattern having a high degree of flexibility in shape.

Figure 4B:
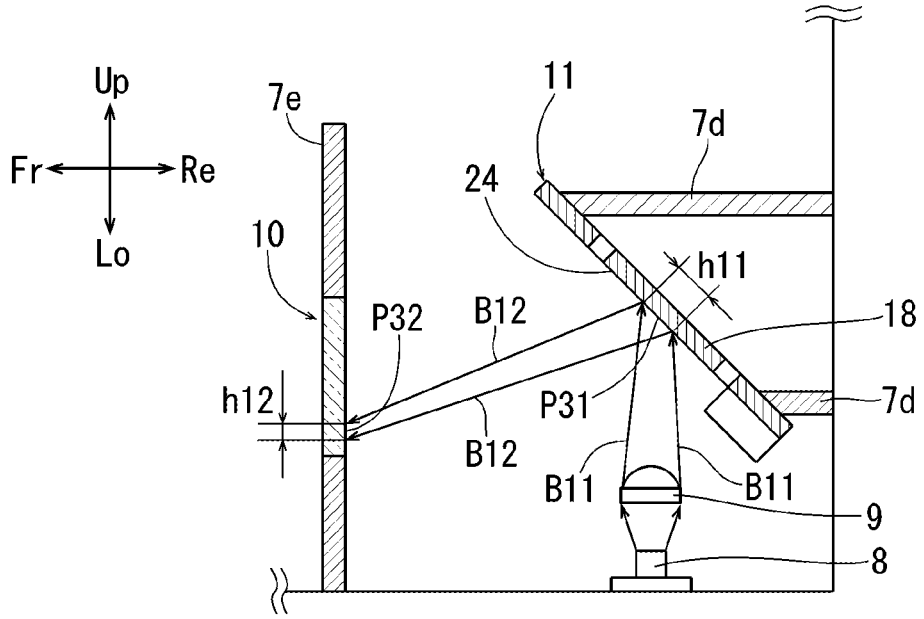
FIG. 4B is a partially enlarged sectional view of the headlamp unit in which the light image to be irradiated onto the phosphor is formed smaller than the light image to be irradiated onto the reflecting mirror.

On the other hand, as shown in FIG. 4B, the larger the size (height h11) of the light image P31 formed by the light B11 irradiated by the condensing lens 9 is, the size (height h12) of the light image P32 irradiated onto the phosphor 10 by the reflected light B12 decreases. That is, the reflected light reflected by the reflecting surface 24 of the scanning mechanism 11 is condensed toward the reflecting surface 24, is reflected on the reflecting surface 24 and is then incident on the phosphor 10. The light image P32 of the reflected light B12 incident on the phosphor 10 from the reflecting surface 24 is formed smaller than the light image P31 of the incident light B11 onto the reflecting surface 24. When the sizes of the light images P31, P32 are set to be h12<h11 and a very small spot light image is irradiated to the phosphor 10, a resolution of the reflected light B12 is improved, so that the vehicle headlamp 1 can form a light distribution pattern having a high resolution.

Second Embodiment

Figure 5:
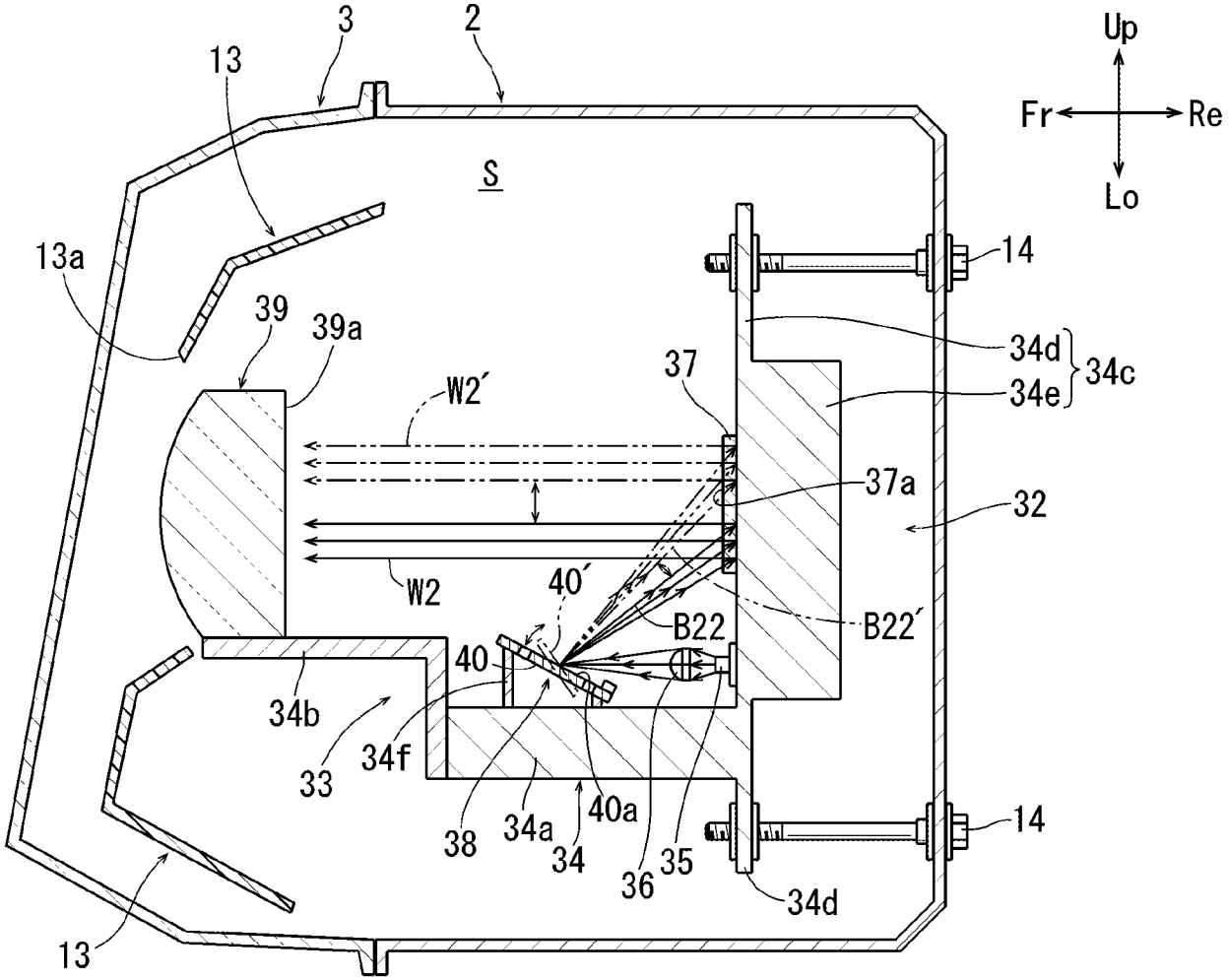
FIG. 5 is a longitudinal sectional view of a vehicle headlamp having a reflection-type phosphor in accordance with a second embodiment.

A vehicle headlamp 31 in accordance with a second embodiment shown in FIG. 5 is an example of a right headlamp having a light reflection-type phosphor 37. The vehicle headlamp 31 of the second embodiment has the configuration similar to the vehicle headlamp 1 of the first embodiment, except that a headlamp unit 32 is different from the headlamp unit 4 of the first embodiment. The headlamp unit 32 of FIG. 5 is configured by integrating a headlamp unit 33 for high beam and a headlamp unit for low beam (not shown) with a metallic support member 34, and is disposed in the lamp chamber S.

Each of the headlamp unit 33 for high beam and the headlamp unit for low beam (not shown) includes an excitation light source 35, a condensing lens 36, a phosphor 37, a scanning mechanism 38 and a projection lens 39 shown in FIG. 5. The excitation light source 35, the condensing lens 36, the phosphor 37, the scanning mechanism 38 and the projection lens 39 have the similar shapes and similar configurations to the excitation light source 8, the condensing lens 9, the phosphor 10, the scanning mechanism 11 and the projection lens 12 of the first embodiment, respectively. The excitation light source 35, the condensing lens 36, the phosphor 37, the scanning mechanism 38 and the projection lens 39 are all mounted to the support member 34. The support member 34 has a plate-shaped bottom plate part 34*a* extending in a horizontal direction, a lens support part 34*b* extending upward from a leading end of the bottom plate part 34*a* and then bent forward, and a plate-shaped base plate part 34*c* perpendicularly extending from a base end of the bottom plate part 34*a*. The base plate part 34*c* is configured by a screw fixing part 34*d* and a heat dissipation part 34*e* of which a depth in the front-rear direction is larger than the screw fixing part 34*d*.

As shown in FIG. 5, the excitation light source 35 and the phosphor 37 are fixed to a front surface of the heat dissipation part 34*e* of the support member 34. A front surface 37*a* of the phosphor 37 becomes an incidence surface of light to be incident from the excitation light source 35, a reflecting surface of light to be incident from the excitation light source 35, and an emission surface of light generated in the phosphor 37. The heat generated in the excitation light source 35 upon light emission and the heat generated in the phosphor 37 upon receiving of light having a large heat quantity such as laser light are dissipated via the heat dissipation part 34*e*.

The scanning mechanism 38 is fixed to an upper surface of the bottom plate part 34*a* by a mounting part 34*f*. The condensing lens 36 is fixed to the bottom plate part 34*a* or the base plate part 34*c*. The projection lens 39 is fixed to an upper surface of a leading end of the lens support part 34*b*. The three aiming screws 14 rotatably kept to the lamp body 2 are screwed to the screw fixing part 34*d*, so that the support member 34 of the headlamp unit 32 is tiltably supported to the lamp body 2.

The excitation light source 35 of FIG. 5 is configured by a blue or purple LED light source or a laser light source. When the excitation light source 35 is blue, the yellow light emitted from the phosphor 37 and the light (blue light) from the excitation light source 35 having passed through the phosphor are synthesized, so that white light is formed. Also, when the excitation light source 35 emits purple or ultraviolet light, the lights of the phosphors 37 of two or more types configured to emit blue, red, green and yellow lights and the like are synthesized by the light from the excitation light source 35, so that white light is formed.

The condensing lens 36 and the projection lens 39 are a transparent or semi-transparent plano-convex lens of which a light emission surface has a convex shape, respectively.

The scanning mechanism 38 is formed as a scanning device having a reflecting mirror which is tiltable in a biaxial direction, similar to the scanning mechanism 11.

As shown in FIG. 5, the projection lens 39 of FIG. 5 is fixed to the support member 34. The condensing lens 36 is fixed to the support member 34 to be disposed between the excitation light source 35 and the reflecting surface 40*a* of the reflecting mirror 40 of the scanning mechanism 38, and is configured to condense the light of the excitation light source 35 to be incident on the reflecting surface 40*a*. The scanning mechanism 38 is configured to swing the reflecting mirror 40, as shown with the reference numerals 40 and 40' of FIG. 5, while reflecting light B22, which is emitted from the excitation light source 35 and is condensed by the condensing lens 36, toward the phosphor 37 by the reflecting surface 40*a*. By swinging the reflecting mirror 40, so that the scanning mechanism 38 scans the light B22 condensed by the condensing lens 36, as indicated by the reference numerals B22 and B22'.

The phosphor 37 is fixed to the heat dissipation part 34*e* of the support member 34 to be disposed to face both the reflecting surface 40*a* of the reflecting mirror 40 of the scanning mechanism 38 and the light incidence surface 39*a* of the projection lens 39. The phosphor 37 is configured to re-reflect the blue or purple light B22 received from the reflecting surface 40*a* as the white light W2 toward the projection lens 39.

A side of the phosphor 37 facing the support member 34 is provided with a reflecting surface configured to re-reflect the light reflected by the reflecting surface 40*a* which swings at a part of the scanning region to be scanned by the scanning mechanism 38. The reflecting surface of the phosphor 37 is configured to re-reflect a part of the light which is generated in the phosphor 37 upon receiving the light which is generated from the excitation light source 35 and reflected on the reflecting surface 40*a* to be incident on the phosphor 37, toward the projection lens 39. The reflecting surface of the phosphor 37 is configured to re-reflect a part of the light which is generated from the excitation light source 35 and reflected on the reflecting surface 40*a* to pass the incidence surface of the phosphor 37, toward the projection lens 39.

The projection lens 39 is disposed in the vicinity of the front end opening 13*a* of the extension reflector 13 provided in the lamp chamber S. The projection lens 39 is configured to transmit the light (refer to the reference numerals W2 and W2' of FIG. 5) which is scanned up and down and right and left by the scanning mechanism 38 and is reflected by the phosphor 37, toward the front cover 3. The light having passed through toward the front cover 3 forms a white light distribution pattern having a predetermined shape based on the scanning, in front of the vehicle.

Modified Example 1 of First Embodiment

Figure 6:
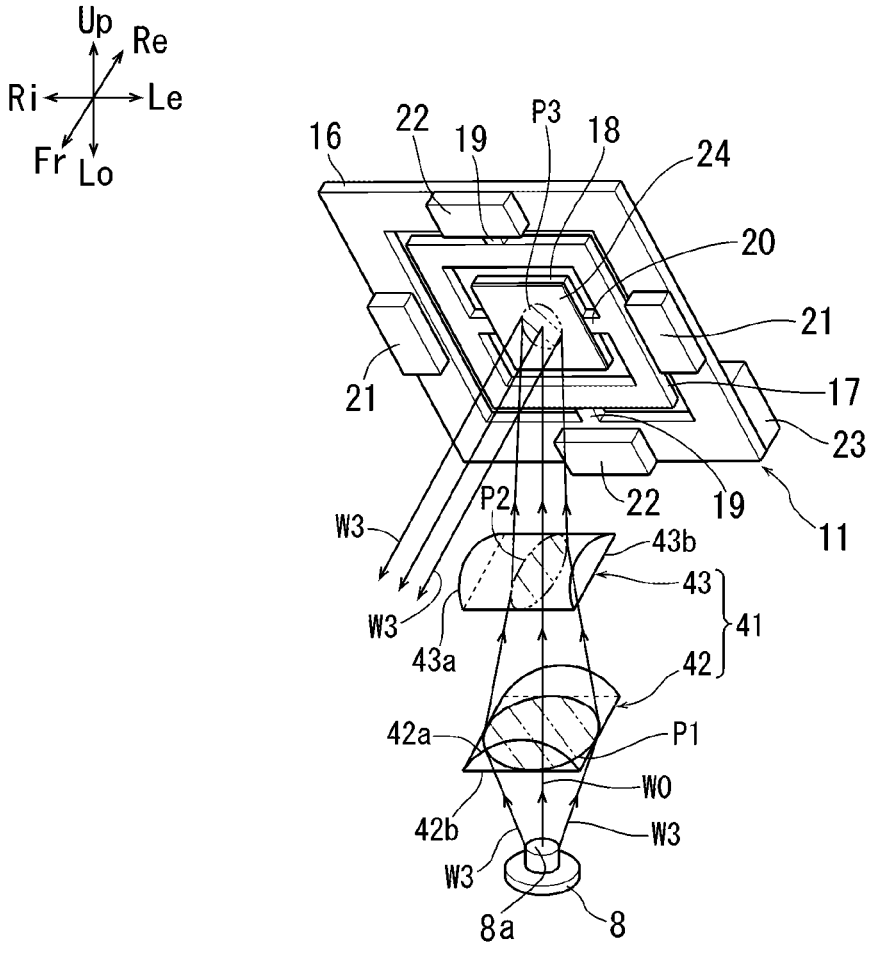
FIG. 6 is a perspective view illustrating a modified example of a condensing lens of the vehicle headlamp of the first embodiment.

Subsequently, a condensing lens 41, which is a modified example of the condensing lens 9 of the first embodiment, is described with reference to FIG. 6. The condensing lens 41 is configured by replacing the condensing lens 9 (refer to FIG. 2) of the first embodiment with a lens group including a first lens 42 and a second lens 43. The first lens 42 and the second lens 43 are both formed of transparent or semi-transparent resin, glass or the like. The first lens 42 and the second lens 43 are both rectangular plano-convex lenses having the same shape, as seen from above, in which upper surfaces 42*a*, 43*a* are convex surfaces and lower surfaces 42*b*, 43*b* are planar surfaces. Both the upper surface 42*a* of the first lens 42 and the upper surface 43*a* of the second lens 43 have a convex shape obtained by bending a planar surface into a circular arc shape, respectively. The lower surface 42*b* of the first lens 42 is disposed to be parallel with an upper surface 8*a* of the excitation light source 8 and to face the upper surface 8*a* of the excitation light source 8. The second lens 43 is disposed such that the upper surface 43*a* faces the reflecting surface 24 and the lower surface 43*b* faces the upper surface 42*a* of the first lens 42 and is parallel with the lower surface 42*b*. The second lens 43 is disposed at a position which is displaced with respect to the first lens 42 by 90° on a planar surface, which includes the lower surface 43*b*, about a line WO passing a center of a light flux from the excitation light source 8 to the reflecting surface 24. As shown in FIG. 6, the first lens 42 and the second lens 43 are disposed at positions at which the light flux passing the line WO passes. That is, the second lens 43 is disposed in series with the first lens 42.

As shown in FIG. 6, a light image P1 which is incident on the lower surface 42*b* of the first lens 42 by a light flux W3 from the excitation light source 8 passes through the first lens 42 to be a light image P2 compressed in the right-left direction (an example of the first direction), which is then incident on the lower surface 43*b* of the second lens 43. The light image P2 becomes a light image P3, which is further compressed in the front-rear direction (an example of the second direction) by the second lens 43 having the same shape as the first lens 42 and disposed to be displaced with respect to the first lens by 90°, and is then incident on the reflecting surface 24 of the scanning mechanism 11. The light flux W3 forming the light image P3 is reflected forward by the reflecting surface 24, and sequentially passes through the phosphor 10, the projection lens 12 and the front cover 3, which are shown in FIG. 2, thereby forming the light distribution pattern La as shown in FIG. 3B in front of the vehicle. The condensing lens 41 shown in FIG. 6 has the configuration where the first lens 42 and the second lens 43 sequentially transmit the light flux W3 to deflect the light flux W3 in two directions perpendicular to each other, thereby irradiating a flexible light image such as a circular shape to the phosphor 10 to contribute to the formation of the light distribution pattern La having a high degree of flexibility. That is, the laser light, which is naturally to diffuse in an elliptical shape, sequentially passes through the first lens and the second lens, so that condensing magnifications in the first direction and the second direction are changed and a flexible light image such as a circular shape is thus irradiated onto the phosphor.

In the meantime, the condensing lens 41 may be configured by an anamorphic lens, instead of the first lens 42 and the second lens 43. When the anamorphic lens is used as the condensing lens 41, the light image is compressed and enlarged by the light passing through the anamorphic lens, so that it is possible to irradiate a flexible light image such as a circular shape onto the phosphor.

Third Embodiment

Subsequently a third embodiment of the vehicle headlamp is described with reference to FIGS. 7A and 7B. FIG. 7A is a cross sectional view of a headlamp unit 51 for high beam of a vehicle headlamp 50 in accordance with the third embodiment, which is taken along a position of the headlamp unit 51 for high beam, which is the similar to the position of the line II-II of the headlamp unit 5 for high beam shown FIG. 1.

The vehicle headlamp 50 is an example of a right headlamp having a light reflection-type phosphor. The headlamp unit 51 for high beam has the configuration similar to the headlamp unit 33 for high beam of the second embodiment shown in FIG. 5, except that a direction of a phosphor 54 with respect to an optical axis Lh of a projection lens 56 is different from the direction of the phosphor 37 with respect to the optical axis of the projection lens 39 shown in FIG. 5, a shape of a support member 57 is different from the shape of the support member 34 shown in FIG. 5 and an excitation light source 52, a condensing lens 53 and a scanning mechanism 55 are disposed in a horizontal direction of the phosphor 54.

Each of the headlamp unit 51 for high beam and the headlamp unit for low beam (not shown) include an excitation light source 52, a condensing lens 53, a phosphor 54, a scanning mechanism 55 and a projection lens 56 shown in FIG. 7A. The excitation light source 52, the condensing lens 53, the phosphor 54, the scanning mechanism 55 and the projection lens 56 have the similar shapes and similar configuration to the excitation light source 35, the condensing lens 36, the phosphor 37, the scanning mechanism 38 and the projection lens 39 of the second embodiment. The excitation light source 52, the condensing lens 53, the phosphor 54, the scanning mechanism 55 and the projection lens 56 are all mounted to a support member 57.

The support member 57 has a plate-shaped bottom plate part 57*a* extending in a horizontal direction, side plate parts 57*b*, 57*c* extending upward from a left end portion and a right end portion of the bottom plate part 57*a*, a lens support part 57*d* integrated to leading end portions of the side plate parts 57*b*, 57*c*, and a base plate part 57*e* integrated to base end portions of the left and right side plate parts 57*b*, 57*c*. The lens support part 57*d* is configured by a cylindrical part 57*d*1 configured to hold the projection lens 56 therein and a flange part 57*d*2 formed at a base end portion of the cylindrical part 57*d*1 and integrated to the leading ends of the side plate parts 57*b*, 57*c*. The base plate part 57*e* is configured by a screw fixing part 57*f*, a heat dissipation part 57*g* of which a depth in the front-rear direction is larger than the screw fixing part 57*f*, and a phosphor support part 57*h* protruding forward from the heat dissipation part 57*g*. In the cross sectional view shown in FIG. 7A, when a straight line perpendicular to the optical axis Lh and extending in the horizontal direction is denoted with L1, the phosphor support part 57*h* has a phosphor support surface 57*i* inclined with respect to the straight line L1 by an angle θ.

The phosphor 54 shown in FIG. 7A is fixed to the phosphor support surface 57*i* of the support member 57 to be inclined with respect to the straight line L1 extending in the direction perpendicular to the optical axis Lh of the projection lens 56 by the angle θ.

The excitation light source 52 is fixed to the base plate part 57*e* with facing forward at a side of the base plate part 57*e* facing the phosphor 54.

The scanning mechanism 55 is fixed to the left side plate part 57*b* ahead of the excitation light source 52. The scanning mechanism 55 has a reflecting mirror 58, and the reflecting mirror 58 has a reflecting surface 59.

The condensing lens 53 is disposed between the excitation light source 52 and the reflecting surface 59.

The reflecting surface 59 of the scanning mechanism 55 is disposed to face both the condensing lens 53 and the phosphor 54.

Light B4 emitted from the excitation light source 52 is condensed onto the reflecting surface 59 of the scanning mechanism 55 by the condensing lens 53, and is scanned (refer to the reference numerals B41 and B41'), based on the right and left swinging (refer to the reference numerals 58 and 58') of the reflecting mirror 58 and the up and down swinging thereof (not shown). Reflected light B41 reflected by the reflecting surface 59 is incident on the phosphor 54 while being scanned with being diffused, and is then re-reflected as white light toward the projection lens 56 by the phosphor 54. Re-reflected light W4 passes through the projection lens 56 and the front cover 3 while being scanned in the right-left direction (refer to the reference numerals W4 and W4 of FIG. 7) and in the upper-lower direction (not shown), thereby forming the light distribution pattern La for white high bean having a predetermined shape as shown in FIG. 3B, in front of the vehicle (not shown).

Subsequently, a light image which is to be irradiated to the phosphor 54 is described with reference to FIG. 7B.

Normally, a reflection-type phosphor is disposed in parallel with a backside of the projection lens 39, i.e., perpendicularly to the optical axis, similar to the phosphor 37 of FIG. 5. An optical axis Li shown in FIG. 7B is parallel with the optical axis Lh shown in FIG. 7A. The reference numeral 54' of FIG. 7B indicates a reflection-type phosphor, on the assumption that it is disposed perpendicularly to the optical axis Li disposed in parallel with a backside of the projection lens 56, similar to the phosphor 37 of FIG. 5. When it is assumed that the lights B41 to B41' (refer to dashed-two dotted lines) diffusively reflected and scanned from the reflecting surface 59 are incident on the phosphor 54', an incidence width of the reflected lights B41 to B41' on the phosphor 54' is a width B1 shown in FIG. 7B.

Figure 7B:
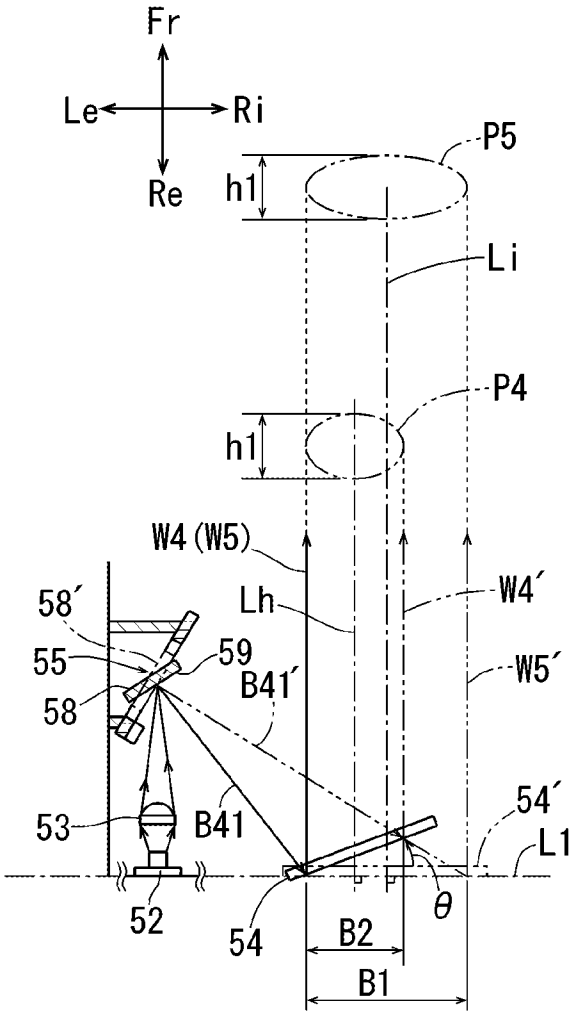
FIG. 7B illustrates a light path and a light image to be formed by the vehicle headlamp of the third embodiment.
Figure 7A:
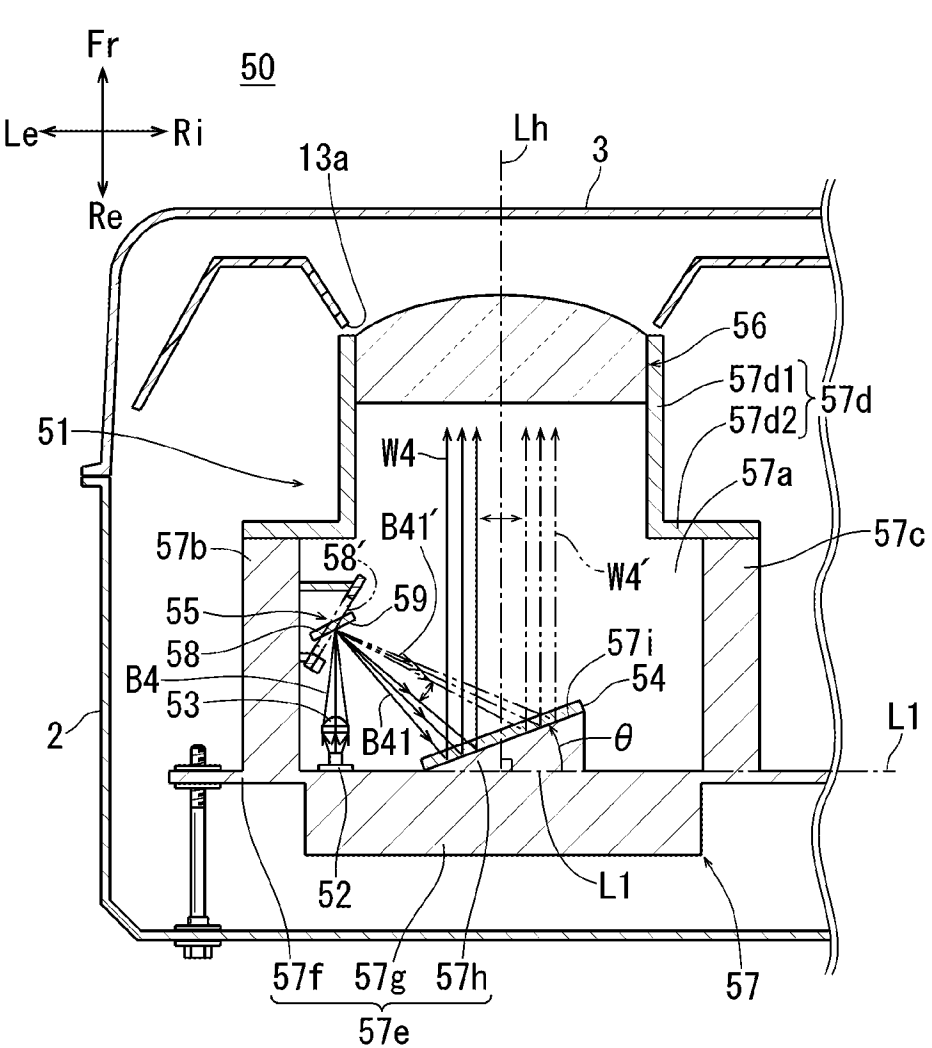
FIG. 7A is a cross sectional view of a vehicle headlamp having a light reflection-type phosphor in accordance with a third embodiment, taken along a line II-II of FIG. 1.

In the meantime, since the phosphor 54 is disposed to be inclined with respect to the straight line L1 perpendicular to the optical axis Lh by the angle θ with facing the reflecting surface 59, an incidence width of the reflected light W4 incident on the phosphor 54 is a width B2 shown in FIG. 7B, which is smaller than the width B1.

A light image P4 formed by the reflected lights W4 to W4' emitted from the phosphor 54 is formed as an elliptical shape having a longitudinal width B2 smaller than the width B1 while keeping a height hi, which is the same as the light image P5 formed by the reflected lights W5 to W5' assumed to be emitted to the phosphor 54', as shown in FIG. 7B. That is, the phosphor 54 is disposed with being inclined with respect to the direction perpendicular to the optical axis of the projection lens 56 by the angle θ. As described above, the phosphor 54 is disposed to face (directly face) the reflecting surface 59 of the reflecting mirror 58 of the scanning mechanism 55. The phosphor is disposed in this way, so that a shape of the light image P4 of the reflected light B41 incident on the phosphor 54 is formed narrow (the width B2) in an inclination direction of the reflecting mirror 58 with respect to the projection lens 56, as shown in FIG. 7B.

According to the vehicle headlamp 50 of the third embodiment, since it is possible to flexibly modify the shape of the light image P4 based on the inclination angle θ of the phosphor 54 with respect to the straight line L1, it is possible to form the light distribution pattern having a high degree of flexibility.

Fourth Embodiment

Figure 8:
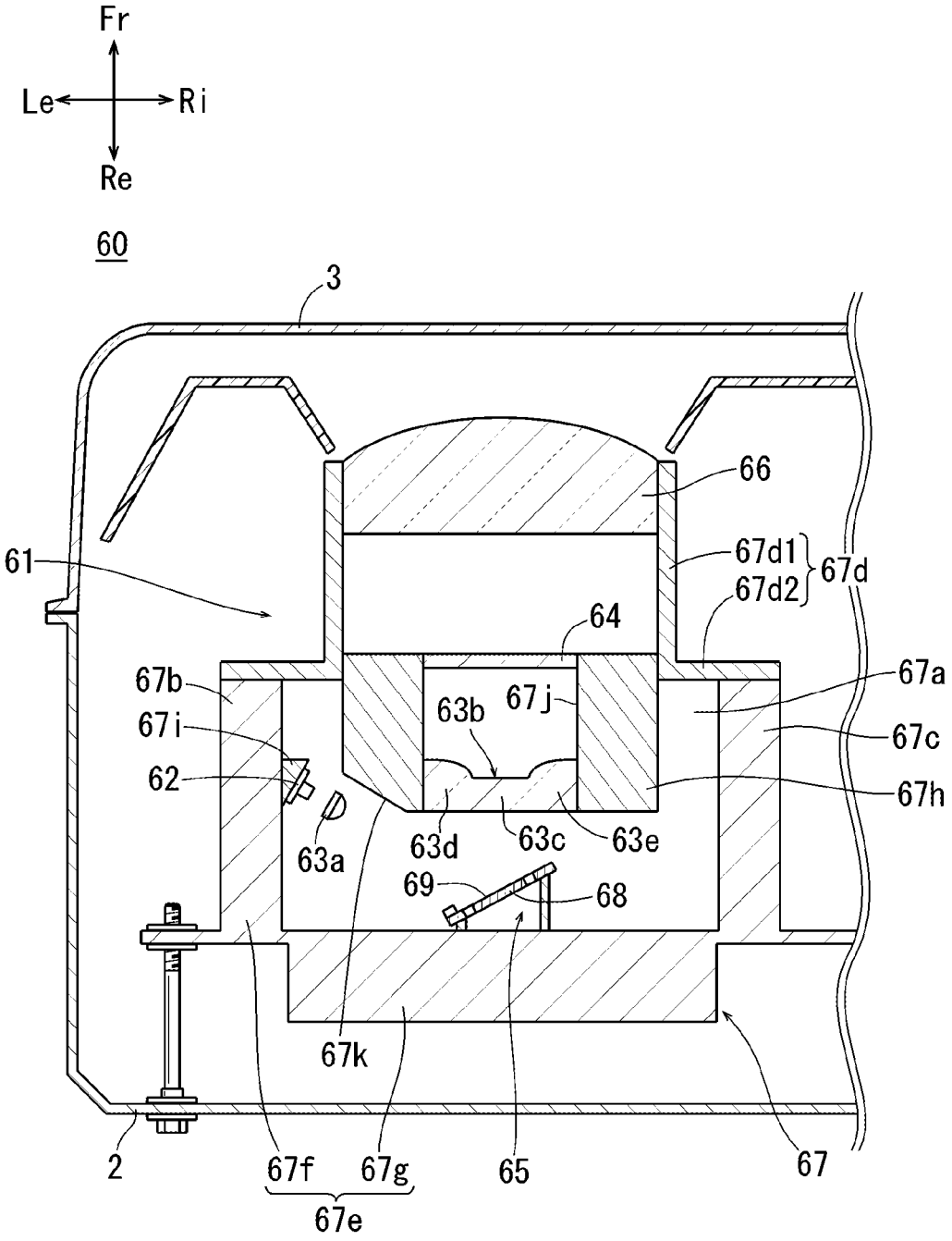
FIG. 8 is a cross sectional view of a vehicle headlamp having a light transmission-type phosphor in accordance with a fourth embodiment, taken along a line II-II of FIG. 1.

Subsequently, a vehicle headlamp 60 in accordance with a fourth embodiment is described with reference to FIGS. 8 and 9. FIG. 8 is a cross sectional view of a headlamp unit 61 for high beam of the vehicle headlamp 60 in accordance with the fourth embodiment, which is taken along the same position as the position of the line II-II of the headlamp unit 5 for high beam shown FIG. 1.

The vehicle headlamp 60 illustrates an example of a right headlamp having a light transmission-type phosphor 64. The headlamp unit 61 for high beam has the configuration similar to the headlamp unit 5 for high beam of the first embodiment shown in FIGS. 2 and 3, except that a shape of a support member 67 is different from the support member 7 shown in FIG. 2, an excitation light source 62 is disposed at a side obliquely leftward and forward from a reflecting surface 69 of a reflecting mirror 68 of a scanning mechanism 65 and a deflector lens 63*b* is provided. The reflecting mirror 68 shown in FIG. 8 corresponds to the second rotating body 18 of the scanning mechanism 11 of the first embodiment shown in FIGS. 2 and 3.

The headlamp unit 61 for high beam and the headlamp unit for low beam (not shown) include an excitation light source 62, a condensing lens 63*a*, a deflector lens 63*b*, a phosphor 64, a scanning mechanism 65 and a projection lens 66 shown in FIG. 8, respectively. The excitation light source 62, the condensing lens 63*a*, the deflector lens 63*b*, the phosphor 64, the scanning mechanism 65 and the projection lens 66 are all mounted to a support member 67.

The excitation light source 62, the condensing lens 63*a*, the phosphor 64, the scanning mechanism 65 and the projection lens 66 have the similar shapes and similar configurations to the excitation light source 8, the condensing lens 9, the phosphor 10, the scanning mechanism 11 and the projection lens 12 of the first embodiment, respectively.

The support member 67 has a plate-shaped bottom plate part 67*a* extending in a horizontal direction, a left side plate part 67*b* and a right side plate part 67*c* extending upward from a left end portion and a right end portion of the bottom plate part 67*a*, a lens support part 67*d* integrated to leading end portions of the left side plate part 67*b* and the right side plate part 67*c*, a base plate part 67*e* integrated to base end portions of the left side plate part 67*b* and the right side plate part 67*c*, and a holder 67*h*. The left side plate part 67*b* is provided with a light source support part 67*i* to which the excitation light source 62 can be fixed to face the reflecting surface 69 of the scanning mechanism 65.

The condensing lens 63*a* is disposed between the excitation light source 62 and the reflecting surface of the scanning mechanism 65. The reflecting mirror 68 of the scanning mechanism 65 is configured to swing right and left at high speed.

The lens support part 67*d* is configured by a cylindrical part 67*d*1 configured to hold the projection lens 66 therein and a flange part 67*d*2 formed at a base end portion of the cylindrical part 67*d*1 and integrated to the leading ends of the left side plate part 67*b* and the right side plate part 67*c*. The base plate part 67*e* is configured by a screw fixing part 67*f* and a heat dissipation part 67*g*. The holder 67*h* has a cylindrical shape. The holder 67*h* has a square hole-shaped hollow portion 67*j* formed at a center, and a notched part 67*k* formed to avoid the light flux emitted from the excitation light source 62 at a left rear end portion.

The phosphor 64 is fixed to a leading end of the hollow portion 67*j* so as to face the projection lens 66. The deflector lens 63*b* is fixed to a rear end of the hollow portion 67*j* so as to face both the front phosphor 64 and the rear reflecting surface 69.

Figure 9:
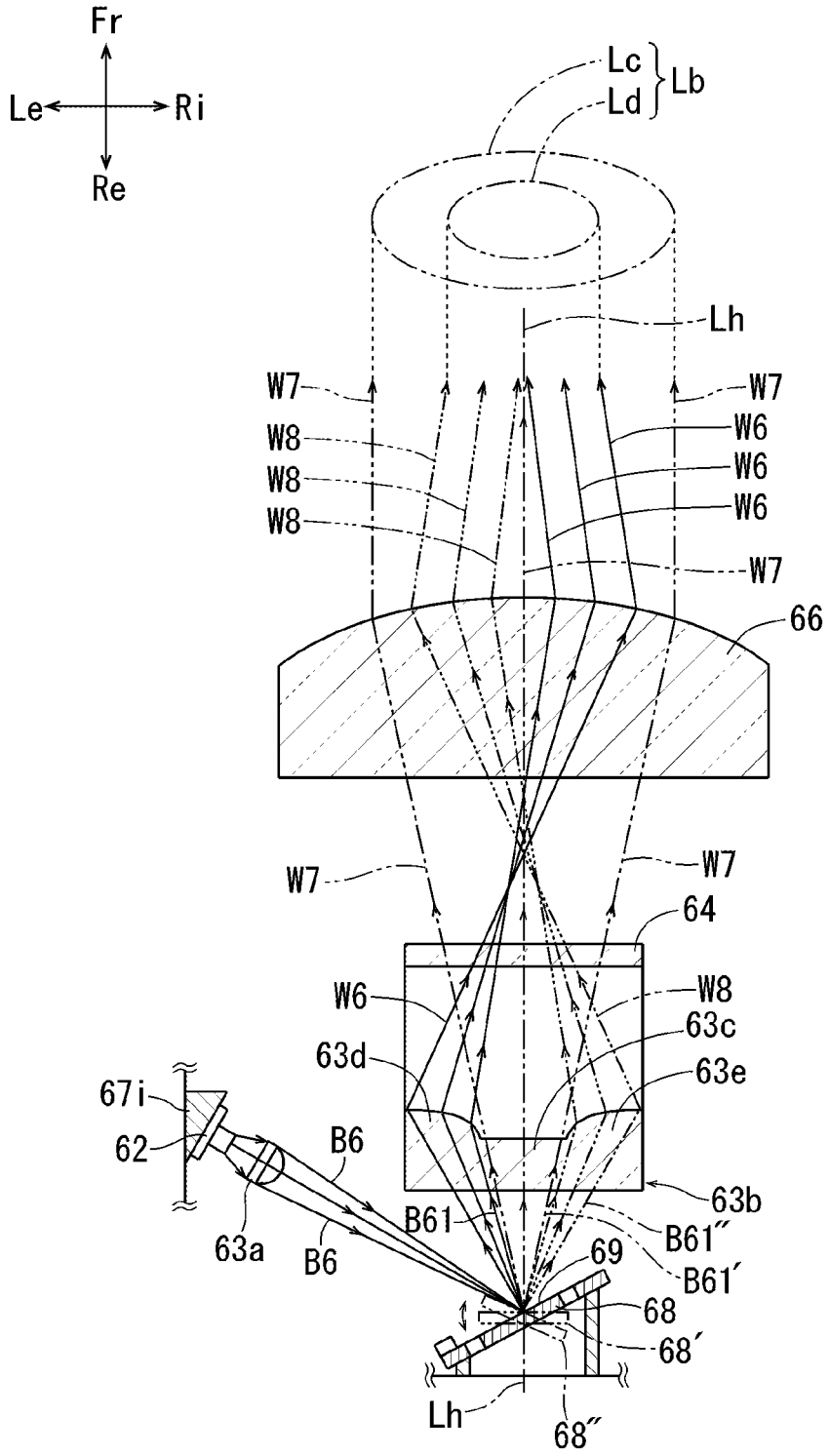
FIG. 9 illustrates a light path and a light image to be formed by the vehicle headlamp of the fourth embodiment.

As shown in FIG. 9, emitted light B6 emitted from the excitation light source 62 is condensed onto the reflecting surface 69 of the reflecting mirror 68 of the scanning mechanism 65 by the condensing lens 63*a*. The emitted light B6 condensed onto the reflecting surface 69 is reflected on the reflecting surface 69 and becomes reflected light B61. The reflected light B61 is scanned (refer to the reference numerals B61' and B61") based on the high-speed right and left swinging of the reflecting mirror 68 indicated by the reference numerals 68' and 68" and the high-speed up and down swinging (not shown) and is scanned toward the deflector lens 63*b*.

The deflector lens 63*b* is formed by a central transparent part 63*c* (the first region) and first and second condensing parts (63*d*, 63*e*: the second region) disposed at left and right sides of the transparent part 63*c*. The transparent part 63*c* has a flat plate shape. The first condensing part 63*d* and the second condensing part 63*e* are respectively formed to have a plano-convex shape convex forward.

The swinging reflecting mirror 68 faces the first condensing part 63*d*, so that light W6 having passed through the first condensing part 63*d* forms a condensing region Ld of a light distribution pattern. Also, the reflecting mirror 68 swings to a position indicated by the reference numeral 68' to thus face the transparent part 63*c*, so that light W7 (refer to the dashed-two dotted line) having passed through the transparent part 63*c* forms a diffusion region Lc of the light distribution pattern. Also, the reflecting mirror 68 swings to a position indicated by the reference numeral 68" to thus face the second condensing part 63*e*, so that light W8 (refer to the dashed-three dotted line) having passed through the second condensing part 63*e* forms a condensing region Ld of the light distribution pattern, together with the light W6.

Both the lights W6 and W8 having passed through the first condensing part 63*d* and the second condensing part 63*e* are condensed to an inner side of the light having passed through the transparent part 63*c*, thereby forming the condensing region Ld brighter than the diffusion region Lc, i.e., a hot spot, which is a region brighter than the diffusion region Lc, in the light distribution pattern Lb.

According to the vehicle headlamp 60 of the fourth embodiment, the light W6 which is to be generated when the reflecting mirror 68 is disposed in the vicinity (at a position indicated by the reference numeral 68') of the left swinging end (the maximum swinging position in the left direction) is condensed to the first condensing part 63*d* of the deflector lens 63*b*, and the light W8 which is to be generated when the reflecting mirror 68 is disposed in the vicinity (at a position indicated by the reference numeral 68") of the right swinging end (the maximum swinging position in the right direction) is condensed by the second condensing part 63*e* of the deflector lens 63*b*, so that the lights W6 and W8 can be used for the formation of the hot spot of the light distribution pattern. For this reason, according to the vehicle headlamp 60 of the fourth embodiment, it is possible to form the light distribution pattern having a high degree of flexibility.

Meanwhile, in the vehicle headlamp 60 of the fourth embodiment, the deflector lens 63*b* is configured by the condensing part and the transparent part. However, the configuration of the deflector lens is not limited thereto. For example, at least a part of the deflector lens 63*b* may be formed to include a diffusion part. Also, the condensing part or diffusion part of the deflector lens 63*b* may be configured such that the light images to be formed by the lights W6 and W8 are to be formed into a light distribution pattern having a uniform illuminance distribution and to coincide with the light image to be formed by the light W7, instead of forming the hot spot.

Fifth Embodiment

Figure 10A:
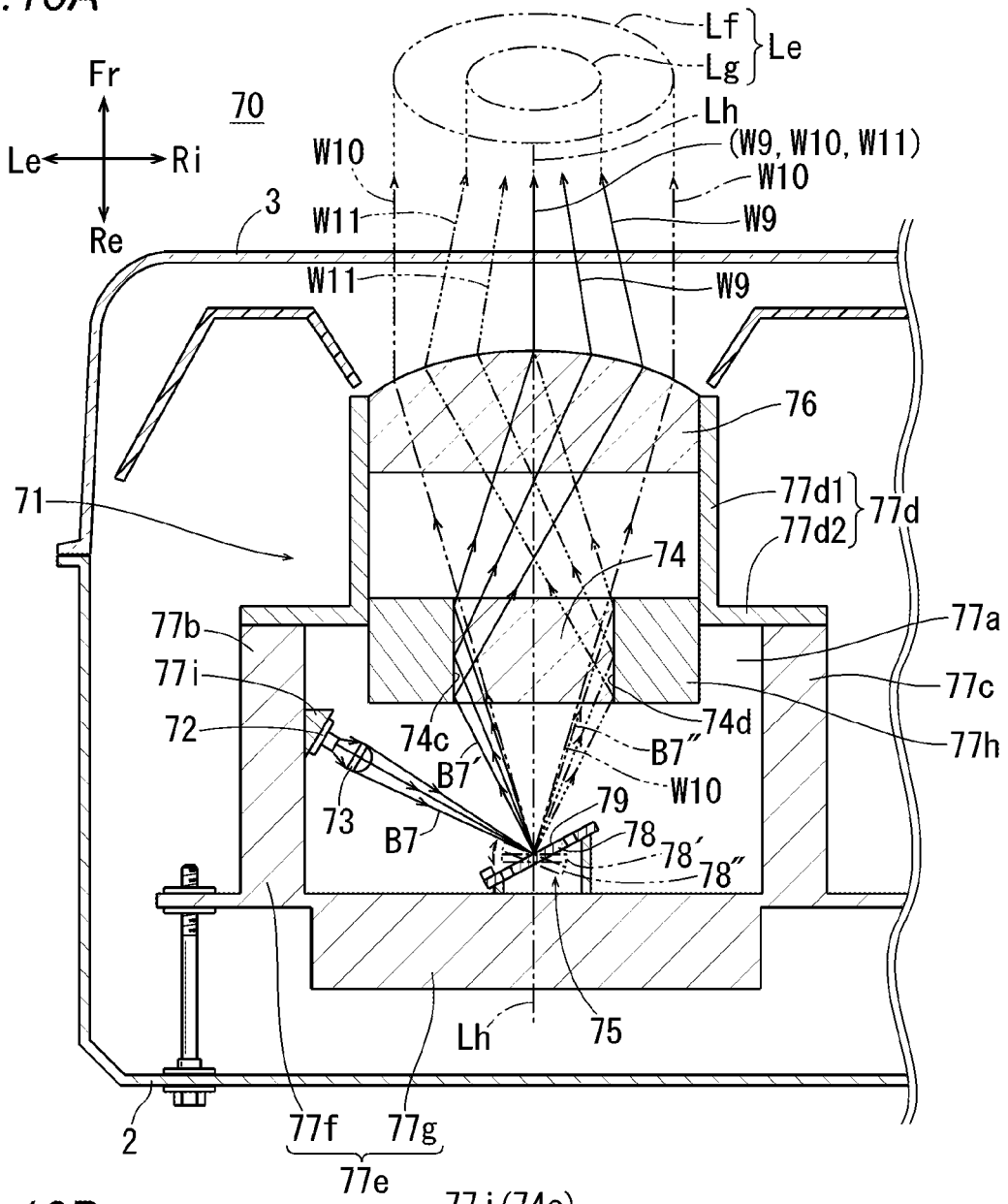
FIG. 10A is a cross sectional view of a vehicle headlamp having a light transmission-type phosphor in accordance with a fifth embodiment, taken along a line II-II of FIG. 1.
Figure 10B:
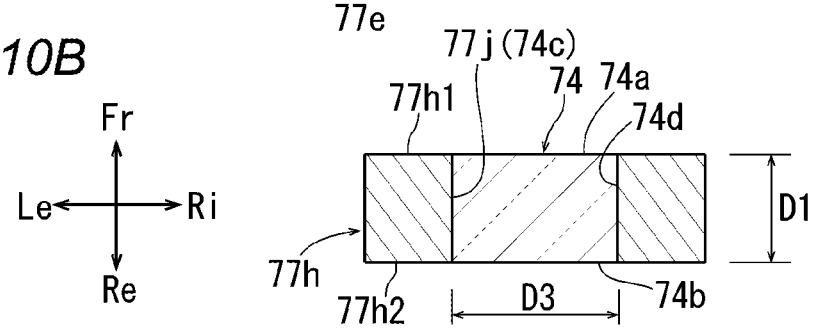
FIG. 10B is a cross sectional view of a holder and the phosphor of the fifth embodiment.

Subsequently, a vehicle headlamp 70 of a fifth embodiment is described with reference to FIGS. 10A and 10B. FIG. 10A is a cross sectional view of a headlamp unit 71 for high beam of the vehicle headlamp 70 in accordance with the fifth embodiment, which is taken along a position of the vehicle headlamp 70, which is the same as the position of the line II-II of the headlamp unit 5 for high beam shown FIG. 1. The vehicle headlamp 70 of the fifth embodiment shown in FIGS. 10A and 10B illustrate an example of a right headlamp having a light transmission-type phosphor 74. The headlamp unit 71 for high beam has the configuration similar to the headlamp unit 61 for high beam of the fourth embodiment shown in FIG. 8, except that only a condensing lens 73 is provided without the deflector lens, a shape of a phosphor 74 is different from the phosphor 64 and a shape of a holder 77*h* is different from the holder 67*h*.

Each of the headlamp unit 71 for high beam and the headlamp unit for low beam (not shown) includes an excitation light source 72, a condensing lens 73, a phosphor 74, a scanning mechanism 75 and a projection lens 76 shown in FIG. 10A. The excitation light source 72, the condensing lens 73, the phosphor 74, the scanning mechanism 75 and the projection lens 76 are all mounted to a support member 77.

The support member 77 has a plate-shaped bottom plate part 77*a* extending in a horizontal direction, a left side plate part 77*b* and a right side plate part 77*c* extending upward from a left end portion and a right end portion of the bottom plate part 77*a*, a lens support part 77*d* integrated to leading end portions of the left side plate part 77*b* and the right side plate part 77*c*, a base plate part 77*e* integrated to base end portions of the left side plate part 77*b* and the right side plate part 77*c*, and a cylindrical holder 77*h*. The left side plate part 77*b* is provided with a light source support part 77*i* to which the excitation light source 72 can be fixed to face a reflecting surface 79 of the scanning mechanism 75.

The condensing lens 73 is disposed between the excitation light source 72 and the reflecting surface 79 of the scanning mechanism 75. A reflecting mirror 78 of the scanning mechanism 75 is configured to swing right and left.

The lens support part 77*d* is configured by a cylindrical part 77*d*1 configured to hold the projection lens 76 therein and a flange part 77*d*2 formed at a base end portion of the cylindrical part 77*d*1 and integrated to the leading ends of the left side plate part 77*b* and the right side plate part 77*c*. The base plate part 77*e* is configured by a screw fixing part 77*f* and a heat dissipation part 77*g*. The holder 77*h* is formed of metal and has a square hole-shaped hollow portion 77*j* formed at a center thereof.

As shown in FIGS. 10A and 10B, the phosphor 74 is formed to have the same depth D1 and width D3 as the hollow portion 77*j*.

The phosphor 74 is fixed to the hollow portion 77*j* in a state where a front end face 74*a* and a rear end face 74*b* are flush with front end rear end faces 77*h*1, 77*h*2 of the hollow portion 77*j*.

The reflecting surface 79 of the scanning mechanism 75 is configured to face at least one of a first inner part 74*c* (the re-reflecting mirror) defined at an inner side of a left surface of the phosphor 74 and a second inner part 74*d* (the re-reflecting mirror) defined at an inner side of the front end face 74*a* of the phosphor 74 and a right surface of the phosphor 74 by swinging the reflecting mirror 78.

As shown in FIG. 10A, emitted light B7 emitted from the excitation light source 72 is condensed by the condensing lens 73, and is reflected toward the phosphor 74 by the reflecting surface 79 of the reflecting mirror 78 of the scanning mechanism 75. Light B7" incident on the first inner part 74*c* at an inner side of the phosphor 74 is re-reflected forward and becomes re-reflected light W9. The re-reflected light W9 passes through the projection lens 76, thereby forming a condensing region La of a light distribution pattern in front of the vehicle.

Also, the reflecting mirror 78 swings to a position denoted by the reference numeral 78', so that light W10 (refer to the dashed-two dotted line) having passed through the front end face 74*a* without being incident on the first inner part 74*c* nor the second inner part 74*d* at the inner side of the phosphor 74 passes through the projection lens 76, thereby forming a diffusion region Lf of the light distribution pattern Le.

Also, the reflecting mirror 78 swings to a position denoted by the reference numeral 78", so that light B7" (refer to the dashed-three dotted line) incident on the second inner part 74*d* at the inner side of the phosphor 74 is re-reflected forward and becomes re-reflected light W11 (refer to the dashed-three dotted line). The re-reflected light W11 passes through the projection lens 76 together with the re-reflected light W9, forming a condensing region Lg of the light distribution pattern in front of the vehicle.

Both the re-reflected light W9 by the first inner part 74*c* of the phosphor 74 and the re-reflected light W11 by the second inner part 74*d* are condensed at an inner side of the light W10 having passed through the front end face 74*a*, thereby forming the condensing region Lg brighter than the diffusion region Lf, i.e., a hot spot in the light distribution pattern Le.

According to the vehicle headlamp 70 of the fifth embodiment shown in FIG. 10A, the re-reflected light W9 which is to be generated when the reflecting mirror 78 is disposed in the vicinity (at a position indicated by the reference numeral 78) of the left swinging end (the maximum swinging position in the left direction) is reflected by the first inner part 74*c* (the re-reflecting mirror) of the phosphor 74, and the re-reflected light W11 which is to be generated when the reflecting mirror 78 is disposed in the vicinity (at a position indicated by the reference numeral 78") of the right swinging end (the maximum swinging position in the right direction) is reflected by the second inner part 74*d* (the re-reflecting mirror) of the phosphor 74, so that the re-reflected lights W9 and W11 can be used for the formation of the hot spot of the light distribution pattern. Therefore, it is possible to form the light distribution pattern Le having a high degree of flexibility.

In the meantime, the lights which are to be incident on the first inner part 74*c* and the second inner part 74*d* of the fifth embodiment may be configured to be irradiated such that the light images to be formed by the re-reflected lights W9 and W11 are to coincide with the light image to be formed by the light W10 while uniformly distributing the illuminance, instead of forming the hot spot.

The present application is based on Japanese Patent Application No. 2016-059505 filed on Mar. 24, 2016, the contents of which are incorporated herein by reference.

The invention claimed is:

1. A vehicle headlamp comprising:

an excitation light source;

a phosphor;

a scanning mechanism which comprises a reflecting mirror configured to be swingable and which is configured to receive light emitted from the excitation light source on a reflecting surface of the reflecting mirror to scan light reflected on the reflecting surface toward the phosphor;

a projection lens which is configured to transmit therethrough light emitted from the phosphor to form a light distribution pattern;

a condensing lens which is configured to condense the light emitted from the excitation light source onto the reflecting surface; and at least one body disposed between the reflecting surface of the reflection mirror and the projection lens, the at least one body configured to redirect the light reflected by the reflecting mirror, through at least a portion of the phosphor, in accordance with a swinging direction of the reflecting mirror.

2. The vehicle headlamp according to claim 1, wherein the condensing lens comprises a first lens configured to change a condensing magnification in a first direction and a second lens disposed in series with the first lens and configured to change a condensing magnification in a second direction perpendicular to the first direction.

3. The vehicle headlamp according to claim 1, wherein the at least one body is a deflector lens that is disposed between the reflecting surface of the reflecting mirror and the phosphor, and the deflector lens has a first region configured to simply transmit the reflected light therethrough to the phosphor, and the deflector lens further has a second region configured to transmit the reflected light therethrough to the phosphor, such that the reflected light is condensed or diffused in accordance with the swinging direction of the reflecting mirror.

4. The vehicle headlamp according to claim 3, wherein the first region of the deflector lens has a flat plate shape, and the second region of the deflector lens has a plano-convex shape.

5. The vehicle headlamp according to claim 1, wherein the at least one body is a re-reflecting mirror which is configured to re-reflect the light reflected by the reflecting mirror, while the reflecting mirror is swinging at a part of a scanning region scanned by the scanning mechanism.

6. The vehicle headlamp according to claim 5, wherein the re-reflecting mirror directly sandwiches the phosphor.

7. The vehicle headlamp according to claim 1, wherein the condensing lens includes an anamorphic lens.

8. The vehicle headlamp according to claim 1, wherein a light image of the reflected light incident on the phosphor from the reflecting surface is formed larger than a light image of an incident light onto the reflecting surface.

9. The vehicle headlamp according to claim 1, wherein a light image of the reflected light incident on the phosphor from the reflecting surface is formed smaller than a light image of an incident light onto the reflecting surface.

10. A vehicle headlamp comprising:

an excitation light source;

a phosphor;

a scanning mechanism which comprises a reflecting mirror configured to be swingable and which is configured to receive light emitted from the excitation light source on a reflecting surface of the reflecting mirror to scan light reflected on the reflecting surface toward the phosphor;

a projection lens which is configured to transmit therethrough light emitted from the phosphor to form a light distribution pattern; and a condensing lens which is configured to condense the light emitted from the excitation light source onto the reflecting surface, wherein the phosphor is disposed such that a front surface of the phosphor, that is configured to receive the light from the reflecting surface, faces towards the projection lens, and the phosphor is inclined with respect to a direction perpendicular to an optical axis of the projection lens.

* * * * *